US010077772B2

(12) United States Patent
Trip

(10) Patent No.: US 10,077,772 B2
(45) Date of Patent: Sep. 18, 2018

(54) ROTARY COMPRESSOR/PUMP

(71) Applicant: Jon Trip, Murrells Inlet, SC (US)

(72) Inventor: Jon Trip, Murrells Inlet, SC (US)

( * ) Notice: Subject to any disclaimer, the term of this patent is extended or adjusted under 35 U.S.C. 154(b) by 380 days.

(21) Appl. No.: 15/063,720

(22) Filed: Mar. 8, 2016

(65) Prior Publication Data

US 2017/0260978 A1 Sep. 14, 2017

(51) Int. Cl.
*F04C 2/44* (2006.01)
*F04C 9/00* (2006.01)

(52) U.S. Cl.
CPC ..... *F04C 9/002* (2013.01); *F04C 2240/10* (2013.01)

(58) Field of Classification Search
CPC .... F04C 9/002; F04C 2240/10; F04B 1/0426; F04B 7/0057; F04B 9/109; F04B 9/111; F04B 9/1115; F04B 23/103
USPC ..... 418/150, 225, 7, 8, 9, 12, 61.1, 62, 68, 418/118, 260, 261, 265; 92/72, 148
See application file for complete search history.

(56) References Cited

U.S. PATENT DOCUMENTS 1,079,743 A * 11/1913 Gallaway ..... F01C 1/46 418/12
1,883,129 A * 10/1932 Trimmer ..... F01C 1/46 418/176
2,092,717 A 9/1937 Jodry
2,289,387 A * 7/1942 Stephens ..... F03C 2/30 254/361
2,391,360 A * 12/1945 Stephens ..... F04C 2/46 418/176
3,474,766 A * 10/1969 Smith ..... F01C 1/46 123/241
3,759,640 A * 9/1973 Hinckley ..... F01C 1/46 137/625.11
3,918,413 A 11/1975 Eiermann et al.
3,924,976 A * 12/1975 Hinckley ..... F01C 1/46 418/12
3,988,082 A * 10/1976 Rogers ..... F01C 1/46 418/244
4,008,693 A 2/1977 Rea et al.
4,106,472 A 8/1978 Rusk
6,371,745 B1 4/2002 Bassine
6,976,832 B1 * 12/2005 Wheeler ..... F04C 2/46 418/172
7,458,791 B2 * 12/2008 Radziwill ..... F01C 1/46 418/150
7,578,278 B2 8/2009 Peitzke et al.
7,845,332 B2 * 12/2010 Wang ..... F01C 21/0809 123/241
8,707,929 B2 * 4/2014 Thomassin ..... F01C 21/003 123/245
8,863,724 B2 10/2014 Shkolnik et al.
8,893,684 B2 11/2014 Fontaine et al.
2006/0169226 A1 8/2006 Keoppel
(Continued)

*Primary Examiner* — Thomas E Lazo
*Assistant Examiner* — Dustin T Nguyen
(74) *Attorney, Agent, or Firm* — B. Craig Killough; Barnwell, Whaley, Patterson & Helms

(57) ABSTRACT

A rotary compressor or pump has a cam with a plurality of lobes mechanically engaging a plurality of pistons. The lobes urge the pistons from an open to a closed position within a piston void, the closure of the piston into the piston void creating compression or pressure of a material. Each piston is linked to another piston, and as one piston is closed by the cam, the other piston is opened by a linkage.

14 Claims, 10 Drawing Sheets

(56) References Cited

U.S. PATENT DOCUMENTS

| | | | |
|---|---|---|---|
| 2010/0143174 | A1 | 6/2010 | Radziwill |
| 2011/0023814 | A1 | 2/2011 | Shkolnik et al. |

* cited by examiner

ROTARY COMPRESSOR/PUMP

FIELD OF THE INVENTION

The present invention relates to pumps and compressors.

BACKGROUND OF THE INVENTION

Pumps are used to pump fluids, including liquids and gasses, and to compress gasses. These devices may be powered by engines or motors that supply rotary motion, which may be converted to a reciprocating motion in some cases. Generally, rotary pumps and compressors may be more efficient since the direction of motion is not changed, as is the case with reciprocating engines. However, there continues to be a need for improved rotary pumps and compressors.

SUMMARY OF THE INVENTION

The rotary compressor or pump comprises an upper annular housing and a lower annular housing that form a stator. The upper annular housing and lower annular housing are mutually adjacent and concentric about a central rotary axle, each of the upper annular housing and the lower annular housing having a plurality of piston voids formed therein and a pistons disposed in each of the plurality of piston voids, and a cam having a plurality of lobes engaging the plurality of pistons. A connecting rod connects adjacent upper and lower pistons to move one piston away from its piston void as the cam pushes a paired piston into its piston void.

DESCRIPTION OF PREFERRED EMBODIMENTS

Figure 1:
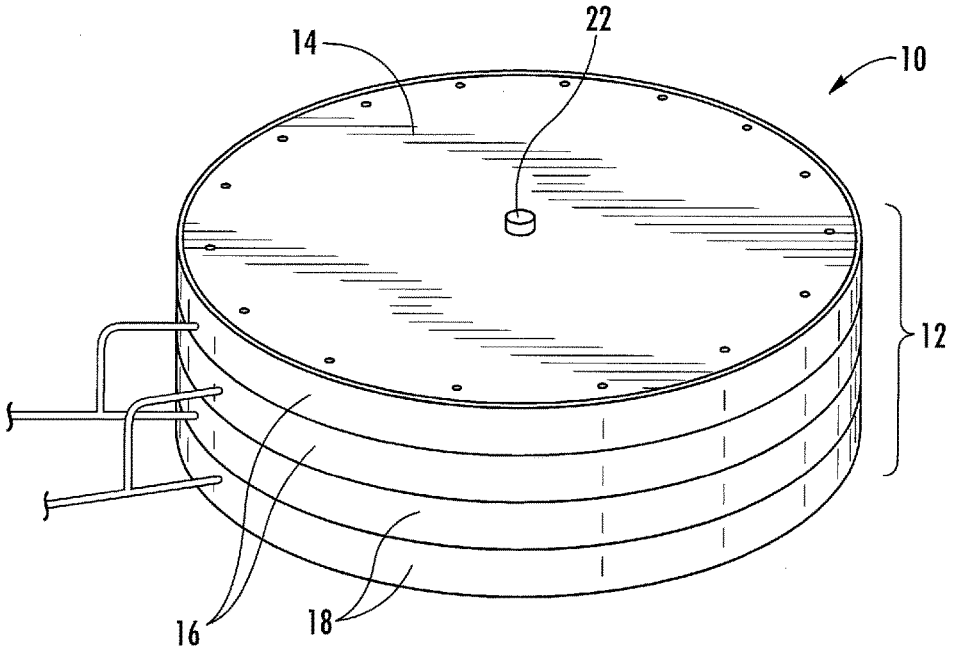
FIG. 1 illustrates one embodiment of a perspective view of the invention apparatus.

In accordance with the illustrations referenced herein, one or more embodiments of a rotary compressor or pump are disclosed and described, generally denoted by the reference character 10.

In one embodiment, as generally depicted in FIG. 1, the rotary compressor or pump 10 comprises a stator 12. The stator 12 comprises an upper annular housing 16 enclosed by a top panel 14 and a lower annular housing 18 enclosed by a bottom panel 20.

The ends of a centrally aligned rotary axle 22 are visible on the outside of the stator 12.

Figure 2:
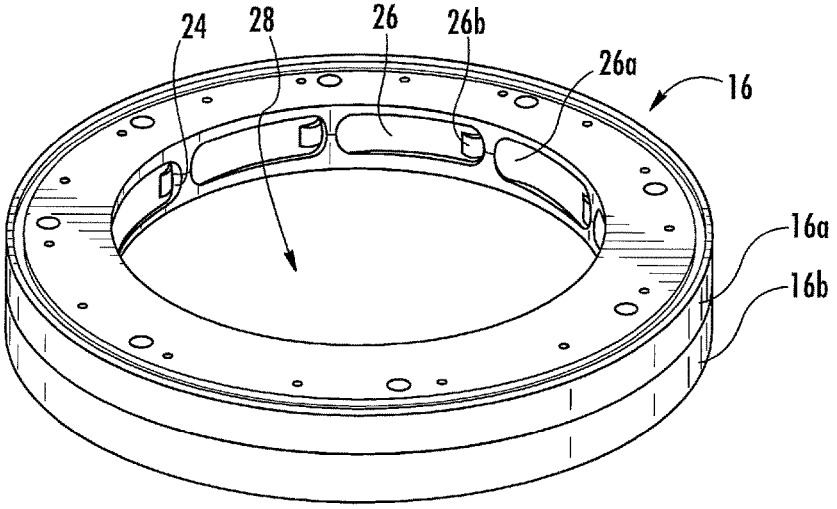
FIG. 2 illustrates a perspective view with a top panel and the lower annular housing removed.
Figure 3:
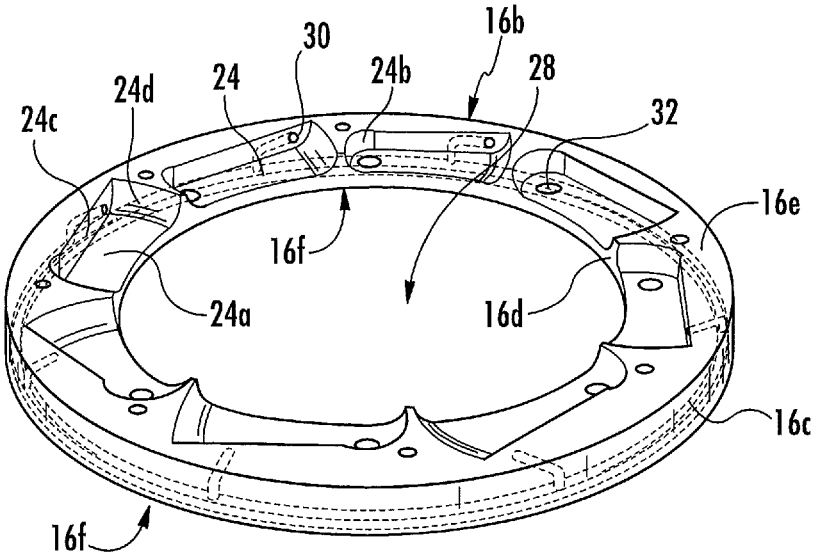
FIG. 3 illustrates a perspective view with a first upper annular housing removed from a second upper annular housing, exposing piston voids and features of each housing element.
Figure 4:
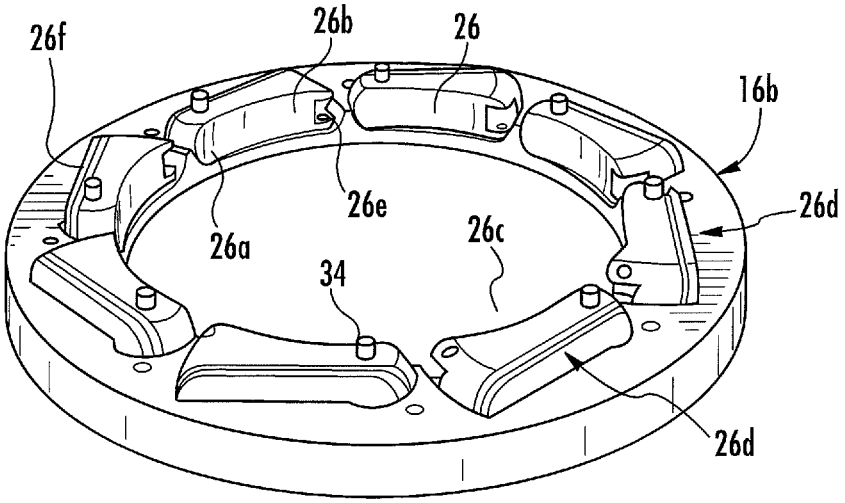
FIG. 4 shows pistons inserted in the piston voids depicted in FIG. 3.
Figure 5:
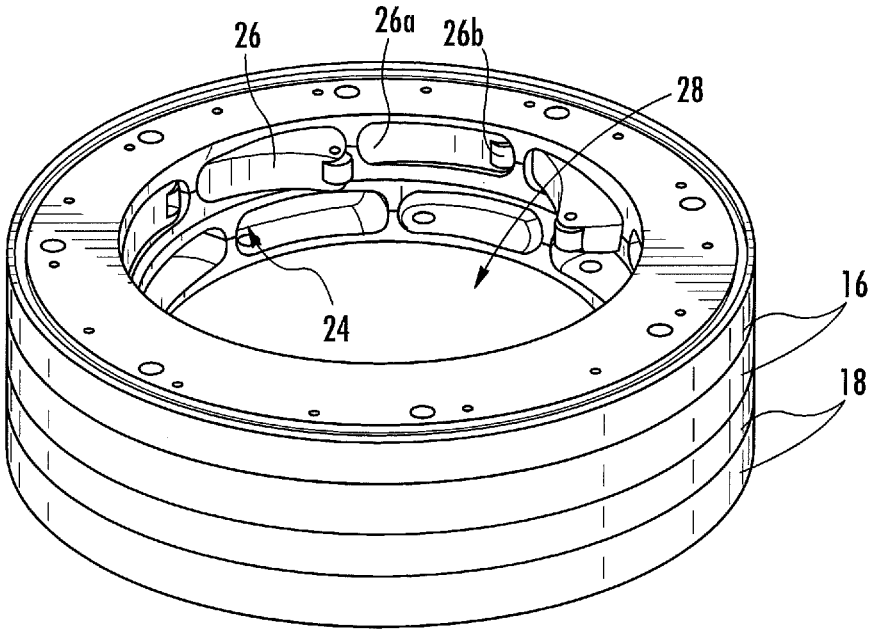
FIG. 5 illustrates a perspective view similar to FIG. 2, and includes a lower annular housing but without pistons disposed in piston voids of the lower annular housing.
Figure 6:
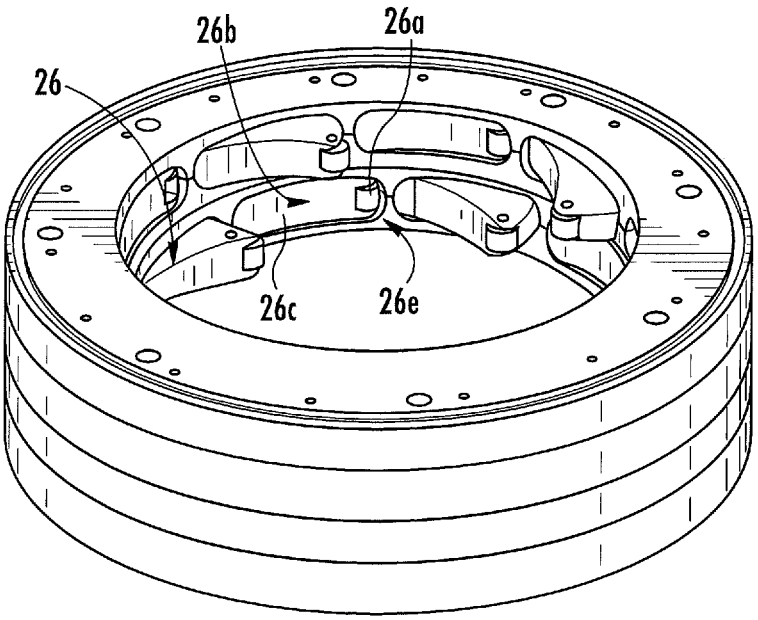
FIG. 6 illustrates a perspective view similar to FIG. 5, with lower pistons disposed in the piston voids, with the lower pistons alternately articulated.

FIG. 2 through FIG. 7 illustrate the upper annular housing 16 and/or the lower annular housing 18, separately or in combination, in greater detail. For example, FIG. 2, FIG. 3, and FIG. 5 illustrate the upper annular housing 16 having a centrally formed cam recess 28. In addition, FIG. 2 (for the upper annular housing 16) as well as FIGS. 5, 6, and 7 (depicting the upper annular housing 16 and lower annular housing 18) illustrate a plurality of piston voids 24 and pistons 26 (with fixed end 26*a* and free end 26*b*) disposed therein.

FIG. 2 depicts the upper annular housing 16, which may be a single unit or multiple units. In one embodiment, the upper annular housing 16 is formed of two units, mutually adjacent first upper annular housing 16*a* and second upper annular housing 16*b*.

The first upper annular housing 16*a* is superjacent to the second upper annular housing 16*b*, and similarly the second upper annular housing 16*b* is subjacent to the first upper annular housing 16*a*. As depicted in FIG. 3, the first upper annular housing 16*a* has been removed to illustrate additional detail in the second upper annular housing 16*b*, although it is envisioned that the first and second upper annular housings 16*a* and 16*b* are substantially mirror images of one another, and are aligned and joined to form the piston voids 24 depicted therein.

Figure 16:
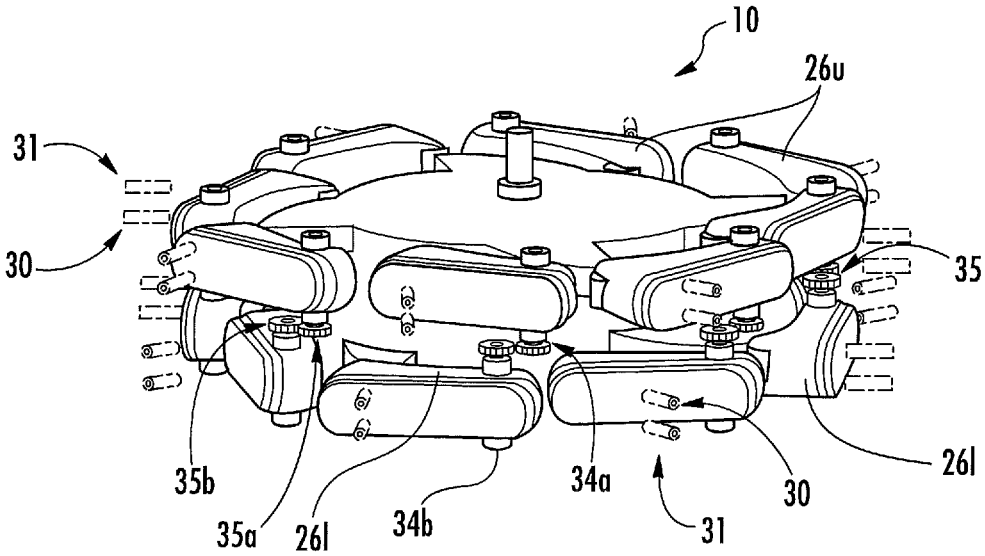
FIG. 16 illustrates the upper and lower pistons in fluid communication with fluid exhaust and intake ports and the opening and closing movements of the adjacent pistons actuated by piston rods and gears.

In FIG. 3, the second upper annular housing 16*b* (representative of each annular housing element 16*a*, 16*b*, 18*a*, 18*b*) comprises an outer circumferential wall 16*c* and an opposing inner circumferential wall 16*d*, and having intermediately disposed top surface 16*e* and bottom surface 16*f* there between to form an annular housing body. The piston voids 24 are recesses formed in the top surface 16*e* and opening at the inner circumferential wall 16*d*. Each piston void 24 includes at least one fluid exhaust port 30 and at least one fluid intake port 31, into which fluid is drawn from or driven to the interior chamber(s) of the annular housing body, as also depicted in FIG. 16. In an embodiment, the exhaust and intake ports are fluidly coupled with separate exhaust and intake chambers that circumscribe the space formed between the outer and inner circumferential walls

16*c* and 16*d* of the upper annular housing 16 (or as representative for lower annular housing 18). This arrangement is virtually identical for the second lower annular housing 18*b*. For the first upper and first lower annular housing elements 16*a* and 18*a*, the voids 24 are formed in the lower surfaces and inner circumferential walls, with the top surfaces and outer circumferential walls intact.

Continuing with FIG. 3, for each of the piston voids 24, approximately one-half of the recess is illustrated. The piston voids 24 comprise a floor 24*a*, and three upstanding walls 24*b*-24*d*. The floor 24*a* and upstanding walls 24*b*-24*d* substantially complement the shape and design of the individual pistons 26 disposed therein. In addition to the at least one fluid exhaust port 30, the piston voids 24 also include a piston rod aperture 32.

FIG. 4 adds the pistons 26 to the piston voids 24 of FIG. 3. Consistent with FIG. 4 (and FIGS. 6, 7, 9, and 11-14), each piston 26 comprises a fixed end 26*a* opposite a free end 26*b*. A curvilinear inside wall 26*c* faces the cam recess 28 formed inside the annular housings 16/18. When urged into the closed position completely within a piston void 24, it is envisioned that the inside wall 26*c* of a piston 26 has a substantially similar profile with the inner circumferential wall 16*d* of the annular housing 16*b* (using the second upper annular housing 16*b* as an example). A substantially linear outside wall 26*d* is formed between fixed end 26*a* and free end 26*b* opposite the inside wall 26*c* and facing the deepest position inside the piston void 24. In addition, the pistons 26 may include a bearing 26*e* positioned at the inner face of the free end 26*b*, envisioned to engage the outermost surface of the cam lobes so encourage release and inhibit impingement during cam and lobe rotation. The pistons 26 may also include a piston ring 26*f* bounding the piston adjacent the linear wall 26*d*.

In particular, and in one embodiment of the piston voids 24 and pistons 26, the piston void floor 24*a* is substantially flat and parallel to the top and bottom surfaces 16*e*, 16*f*, accommodating a substantially flat underside of the piston 26. Upstanding walls 24*b*-24*d* generally complement each piston 26, with the fixed end wall 24*b* having a small sweeping recess to accommodate the curvature of the fixed end 26*a* of the piston 26. The free end wall 24*d* may include a larger sweeping recess to accommodate the larger curvature of the free end 26*b* of piston 26. The piston void wall 24*c* may be substantially linear and flat like the outside linear wall 26*d* of piston 26.

A piston rod aperture 32 may be included in the piston void 24. The aperture 32 accommodates a piston rod 34 utilized to interconnect pistons 26 disposed in the upper annular housing 16 with the adjacent pistons 26 disposed in the lower annular housing. The piston rod apertures 32 and rods 34 may include one or more bearings 33 (e.g., FIG. 9) for facilitating proper and enduring rotational or pivoting movement of the rod 34 in actuating movement of adjacent pistons 26 in the upper and lower annular housings 16 and 18.

As particularly illustrated in FIG. 16, one embodiment of the rods 34 and coupling between the upper and lower pistons 26*u* and 26*l* includes the utilization of complementary gears 35. The upper gear 35*a* depends from the lower terminus of upper rod 34*a*, and the lower gear 35*b* depends from the upper terminus of lower rod 34*b*. As the lower piston 26*l* is pushed closed by a cam lobe into its piston void 24, the upper piston 26*l* to which it is connected by the gear train is opened (moving inwardly toward the cam recess 28). The pistons on either side of 26*u* and 26*l* in the same housing are in an opposite configuration, since the lobes on the cams close every other piston within the housing. Each lower piston will be closed by the cam for the lower housing as the piston directly above it in the upper housing is opened by the gear train. Each upper piston will be closed by the cam for the upper housing as the piston directly below it in the lower housing is opened by the gear train. Each housing has a corresponding cam, with the cams staggered as shown in FIG. 10 to achieve each piston in a housing opening alternately.

Figure 18:
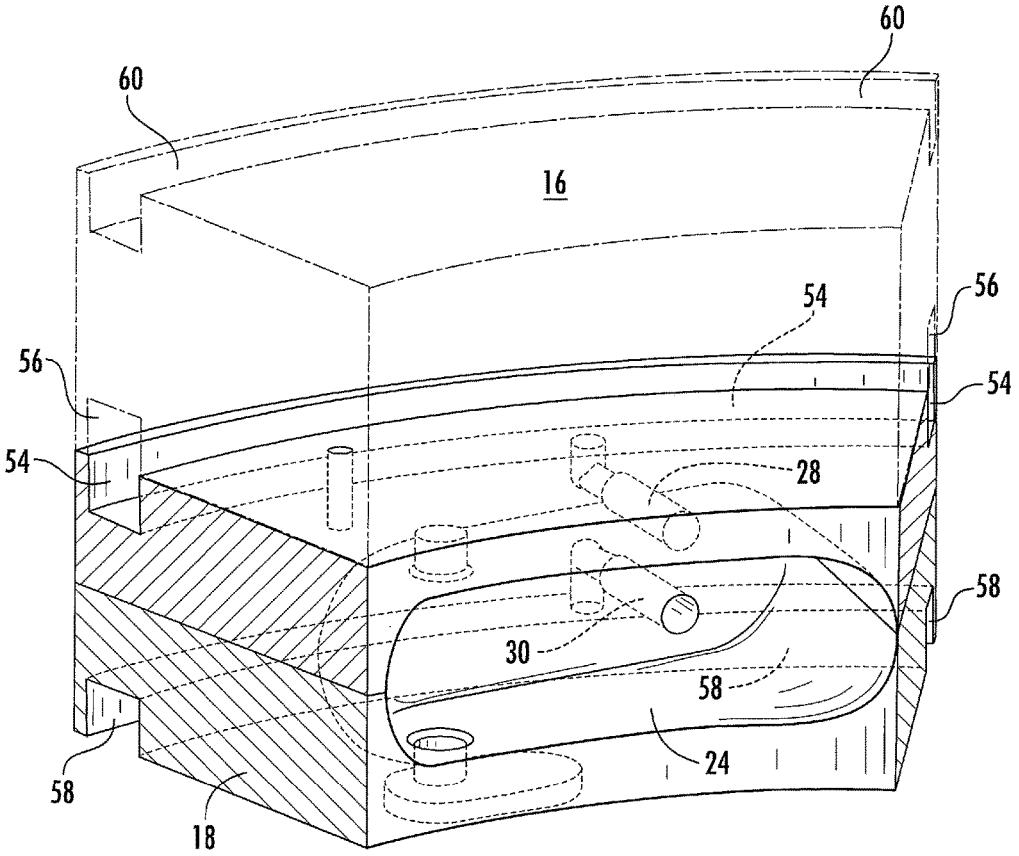
FIG. 18 illustrates a section of a stator in isolation showing internal structure of the stator.

The structure of FIG. 16 mounts in the housing 18, a portion of which is shown in FIG. 18. Channel 54 supplies either low pressure fluid to, or receives high pressure fluid from, piston void 24 through port 31. Channel 54 is enclosed by adjoining channel 56 formed in housing 16. Channel 58 supplies either low pressure fluid or receives high pressure fluid from piston void 24 through port 30. Channel 58 supplies low pressure fluid if channel 54 receives high pressure fluid and receives high pressure fluid if channel 54 supplies low pressure fluid. The channels 56 and 60 of housing 16 also receive or supply fluid in a like manner. The channels 58 and 60 may be enclosed by an adjoining housing or by an enclosure such as panel 14. An annular channel is present in each annular housing, such as 16*a* or 16*b*. The channels communicate with conduits 62, 64. The conduits receive and/or supply fluid from an external source such as tank 50.

Figure 7:
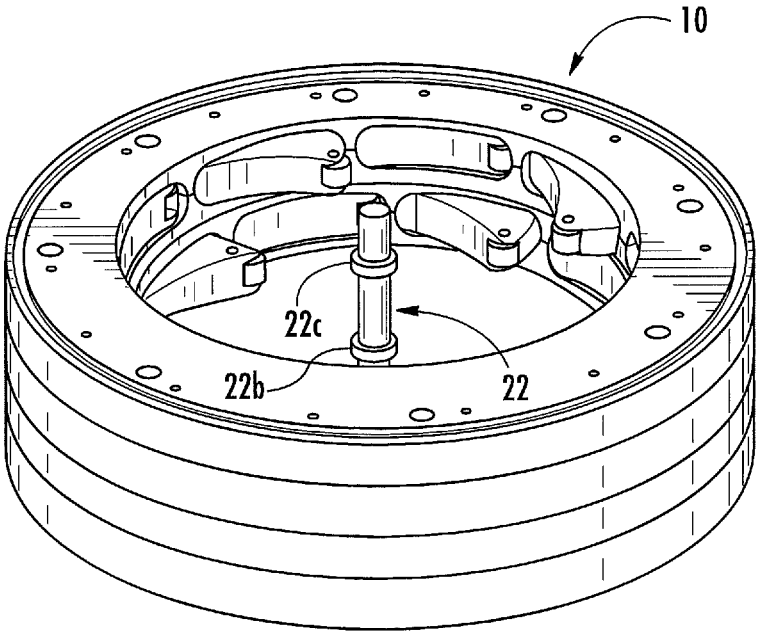
FIG. 7 illustrates a perspective view similar to FIG. 6, with the rotary axle positioned in the cam recess of the stator.

FIG. 7 depicts the annular housings 16 and 18 forming the central cam recess 28, and with the rotary axle 22 aligned therein. It is envisioned that the axle 22 is concentric to the recess 28 and housings 16, 18. As depicted, two bearings 22*a* and 22*b* are aligned along the axle 22 and spaced apart at a length corresponding to the thickness of cam 36. The bearings 22*a* and 22*b* assist in maintaining the axial alignment of the cam 36 and lobes 38 relative to the housings 16, 18 and the corresponding piston voids 24 and pistons 26 therein.

Figure 8:
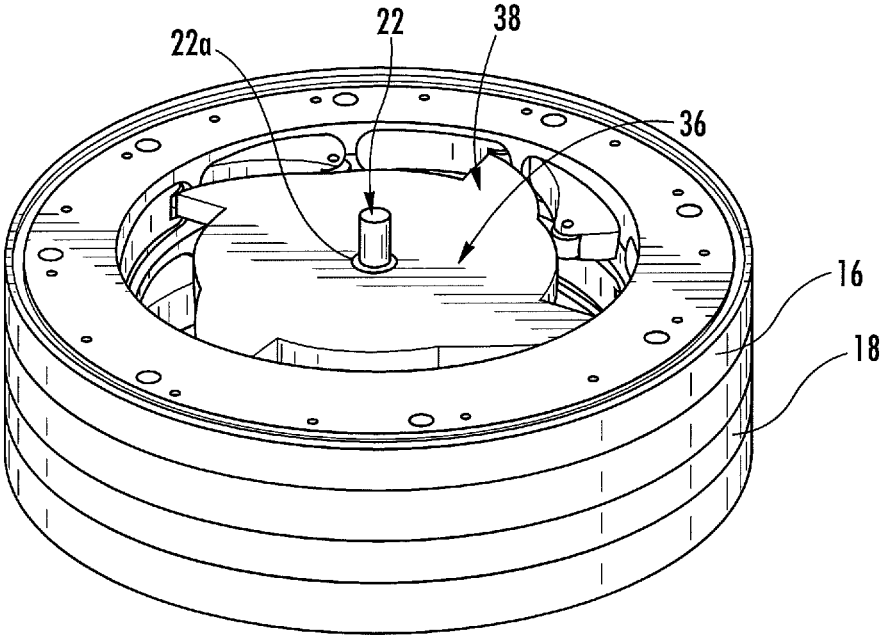
FIG. 8 illustrates a perspective view similar to FIG. 5 with the lobes of the cam alternately engaging the pistons of the upper annular housing.
Figure 9:
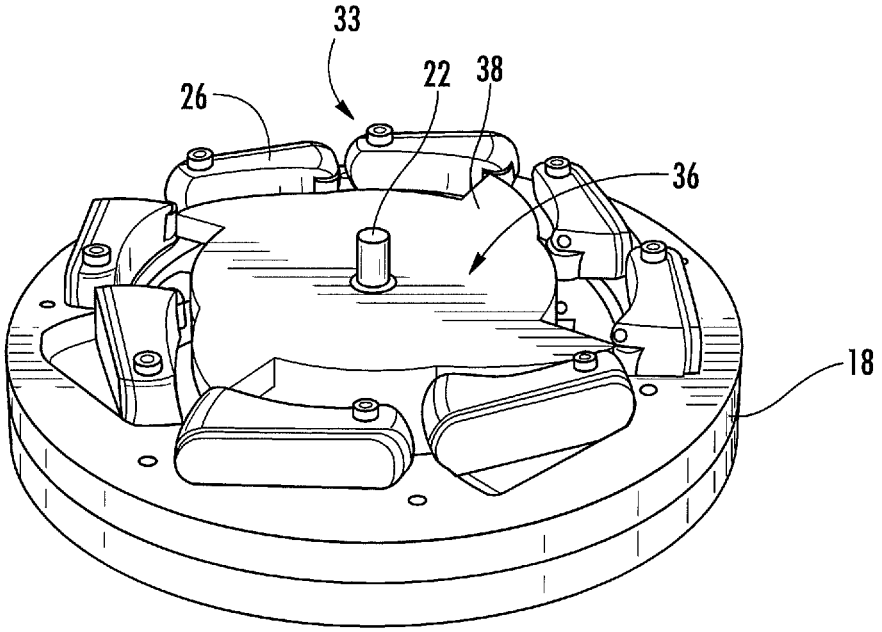
FIG. 9 shows the view of FIG. 8, but with the upper annular housing elements removed.
Figure 10:
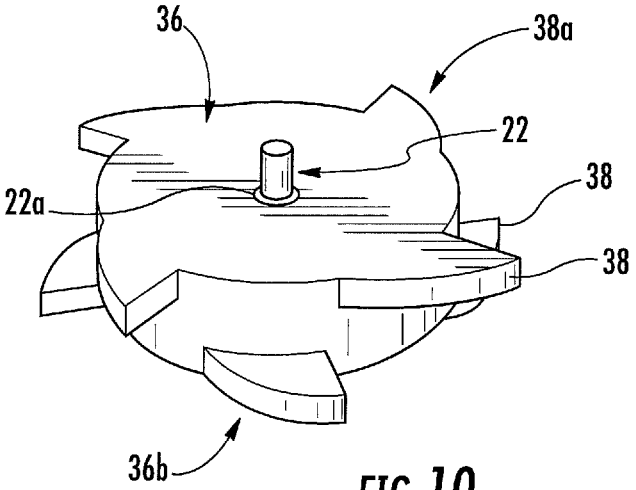
FIG. 10 illustrates a perspective view of the cam.

FIG. 8 through FIG. 10 depict the cam 36 and lobes 38. FIG. 8 and FIG. 9 are similar views, with the upper annular housing 16 removed in FIG. 9 for greater clarity in arrangement and configuration of the cam 36 and lobes 38 relative to the pistons 26. Lobes 38*a* are aligned with the pistons 26 in the upper annular housing 16 and the lower lobes 38*b* are aligned with the pistons in the lower annular housing 18.

As illustrated in FIG. 9, lobes 38*a* engage each piston 26 (in the upper annular housing 16—not depicted) at or near the piston's free end 26*b* in the instant before the lobes 38*a* rotate toward the fixed end 26*a* of the adjacent piston 26. The lobes push the pistons into the corresponding piston voids 24 in sequence.

Figure 11:
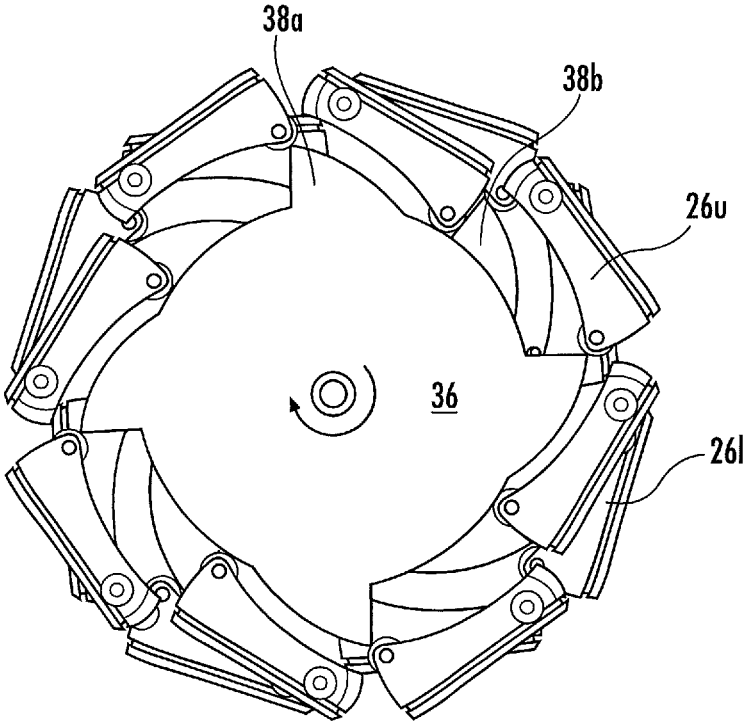
FIG. 11 is a top plan view, with the cam and lobes engaging alternate pistons (shown in isolation) of the upper and lower annular housings.
Figure 12:
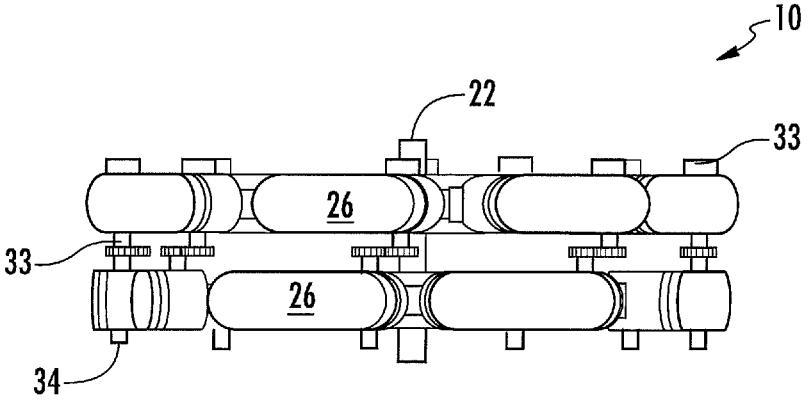
FIG. 12 is an elevation of the device of FIG. 11.

In FIG. 10 and FIG. 11, the cam 36 and lobes 38 are depicted in various perspectives to illustrate the offset arrangement or configuration between the upper lobes 38*a* and the lower lobes 38*b*. FIG. 10 depicts the cam 36 and lobes 38 in isolation. It is envisioned that the cam 36 and lobes 38 may be a single-body construction. It is also envisioned that the cam 36 and lobes 38 may be constructed from multiple bodies and assembled into a unitary body.

In FIG. 11 (and FIG. 13), the cam 36 and lobes 38 are depicted in alignment with the pistons 26 of the upper and lower annular housings 16,18. In this illustration, pistons 26 aligned within the upper annular housing 16 are denoted by reference character 26*u*, and pistons 26 aligned within the lower annular housing 18 are denoted by reference character 26*l* for further clarity.

Figure 13:
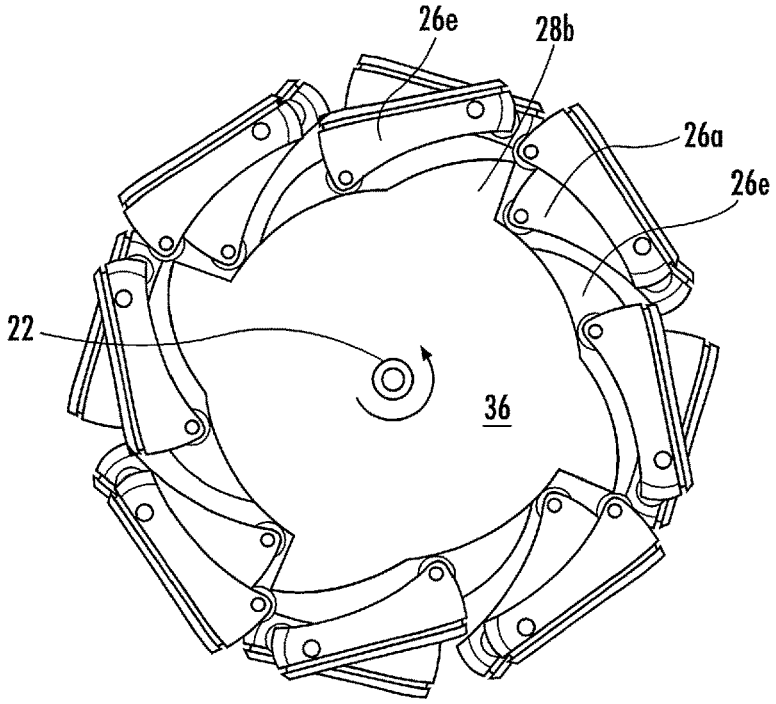
FIG. 13 is a bottom view similar to FIG. 11.

From this top-view perspective, the cam 36 and lobes 38 are depicted as rotating clockwise about the axle 22 (and counterclockwise from the bottom-up view in FIG. 13).

Used only for illustration purposes, and by way of example, the cam 36 comprises upper lobes 38*a* having four lobes 38*a* approximately ninety-degrees apart in the same plane, and lower lobes 38*b* having four lobes 38*b* also approximately ninety-degrees apart in the same plane. As can be seen, the upper lobes 38*a* and the lower lobes 38*b* are offset by approximately forty-five degrees relative to one another. The same number of upper pistons 26*u* and lower pistons 26*l* are provided (eight) in this example, whereby eight pistons 26*u*, 26*l* are engaged simultaneously (four upper and four lower, as depicted), and eight pistons are unengaged. By the physical offset between the upper and lower lobes 38*a* and 38*b*, the upper lobes 38*a* engages the (four) pistons 26*u* at a time interval different from that which the lower lobe set 38*b* engages the (four) pistons 26*l* . When an upper piston 26*u* is in the closed position, the lower piston 26*l* immediately subjacent to that upper piston 26*u* is in the open position, and vice versa. Through the lobes 38*a* and 38*b* offsets and utilizing the piston rod 34 and gear 35 assisting in the articulation between open and closed positions, the cam 36 is capable of maximizing compression.

The number of lobes 38 and pistons 26 utilized may be variable based on desired dimensions, compression output, and other similar factors, and that the number of pistons and lobes will be provided in a 2:1 ratio (two pistons for every lobe), overall and with respect to each of the upper and lower annular housing 16, 18 levels provided. Additional pairs of upper and lower annular housings 16, 18 may be mounted over other pairs of upper and lower annular housings. The housings and axles 22 are connected as modules to increase the capacity of the device. Due to this modularity, the capacity of the device may also be decreased by removing one or more pairs of upper and lower annular housings.

Figure 14:
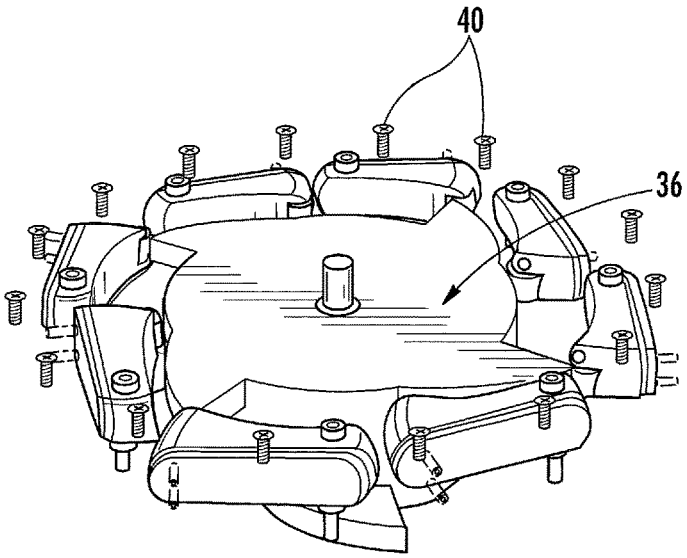
FIG. 14 is a perspective view of the device of FIG. 11 showing fasteners for mounting the top panel to the upper annular housing.
Figure 15:
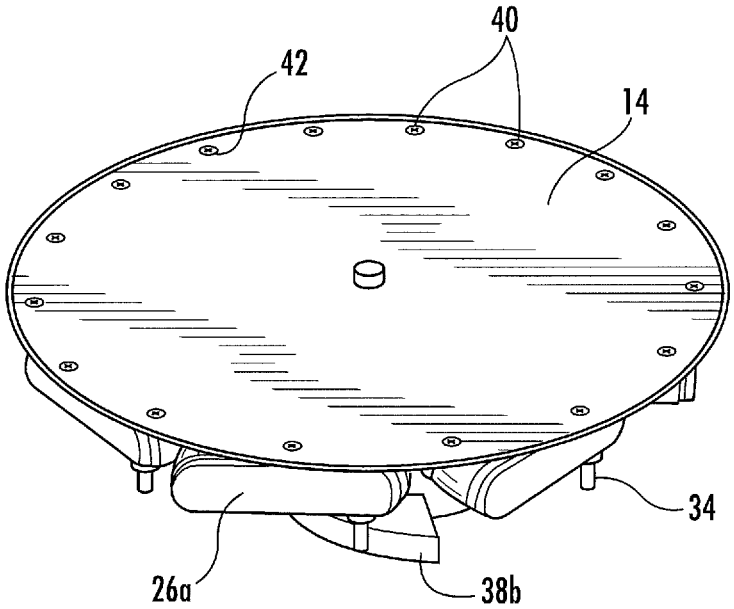
FIG. 15 is a perspective view similar to FIG. 14, with the top panel shown and the fasteners installed.

FIG. 14 and FIG. 15 are similar views, with the lower pistons (denoted elsewhere as 26*l*) removed and top panel 14 removed (but representative of the image turned over to reveal the bottom panel 20 and removed the upper pistons). In FIG. 14, the top panel 14 is absent for the purpose of illustration, revealing the fasteners 40 used to secure the top panel 14 to the upper annular housing 16 through fastener apertures 42 provided in the panel 14.

Figure 17:
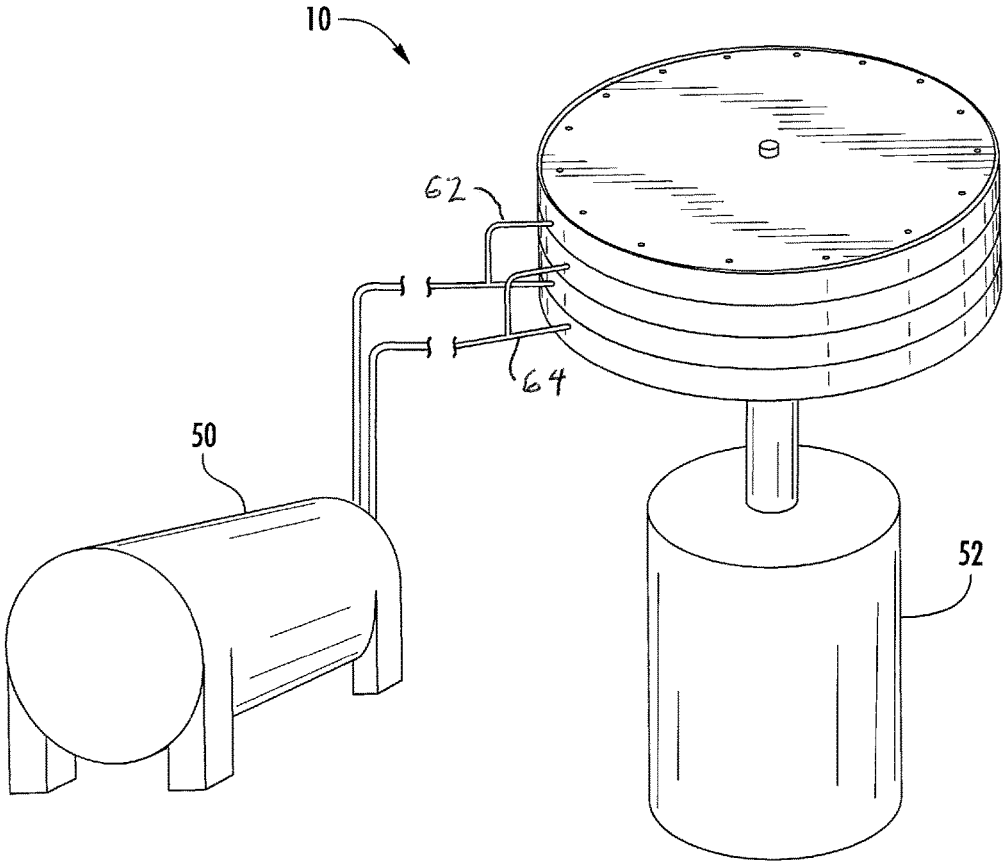
FIG. 17 demonstrates the device used as a pump.

FIG. 17 is an example of the device used as a pump to pump a fluid from a tank 50. A power source, which may be a motor 52, is attached to rotary axle 22 to cause rotation of the cams 36. Rotation of the cams pulls fluid through a conduit such as 62, and into a channel such as 54,56 and ports 31 by means of half of the pistons 26 opening as described herein. The cams 36 continue to rotate as described herein to push the pistons closed, which expels the fluid through ports 30, communicating channels and conduits such as 64. Appropriate valves may be used to present back flow of both the intake and outlet of fluids. The device may be used to pump liquids and gasses, or to compress gasses.

What is claimed is:

1. A rotary compressor or pump, comprising:

a stator having a plurality of piston voids formed therein;

a plurality of pistons mounted in the stator, with each piston pivotally mounted in one of the piston voids of the plurality of piston voids, with each piston linked to another piston;

a cam that rotates within the stator and past each of the plurality of pistons;

wherein, in use, as the cam rotates, lobes of the cam push and pivot one half of the pistons into the piston voids in which the pistons are mounted and the one half of the pistons that are pushed into the piston voids pivot the remaining one half of pistons away from the piston voids in which the remaining one half of pistons are mounted.

2. A rotary compressor or pump as described in claim 1, wherein the cam comprises a central rotary axle and the stator comprises an upper annular housing and a lower annular housing, the upper annular housing and lower annular housing being mutually adjacent and concentric about the central rotary axle.

3. A rotary compressor or pump as described in claim 1, wherein the stator comprises an upper annular housing and a lower annular housing, and wherein the stator is enclosed by a panel, and the central rotary axle extends through the panel.

4. A rotary compressor or pump as described in claim 1, wherein the stator comprises a plurality of exhaust ports and intake ports that communicate with the piston voids, wherein each of the exhaust ports is in communication with an exhaust chamber circumscribing the stator, and each of the intake ports is in communication with an intake chamber circumscribing a second space formed within the stator.

5. A rotary compressor or pump as described in claim 1, wherein each piston of the plurality of pistons comprises a rotating piston rod and each piston of the plurality of pistons is linked to another piston of the plurality of pistons by its rotating piston rod.

6. A rotary compressor or pump as described in claim 1, wherein each piston of the plurality of pistons comprises a rotating piston rod, and wherein each rotating piston rod comprises a gear, and each piston of the plurality of pistons is linked to another piston of the plurality of pistons by an engagement of the gear of the rotating piston rod with the gear of another piston rod of the plurality of pistons.

7. A rotary compressor or pump as described in claim 1, wherein, in use, as the cam continues to rotate, lobes of the cam push and pivot the remaining one half of the pistons into the piston voids in which the remaining one-half pistons are mounted and the remaining one half of the pistons that are pushed into the piston voids pivot the one half of pistons away from the piston voids in which they are mounted.

8. A rotary compressor or pump as described in claim 1, wherein the cam comprises upper lobes that push pistons located in an upper annular housing and lower lobes that push pistons located in a lower annular housing.

9. A rotary compressor or pump as described in claim 1, wherein the cam comprises upper lobes that push pistons located in an upper annular housing and lower lobes that push pistons located in a lower annular housing, wherein the upper lobes are offset from the lower lobes to push one half of the plurality of pistons in the upper annular housing into the piston voids and permit one half of the pistons in the lower annular housing and positioned immediately below the one half of the plurality of pistons in the upper annular housing to be pushed away from the piston voids.

10. A rotary compressor or pump as described in claim 1, wherein each of the pistons comprises a pivoting end opposite a free end, a curvilinear inside wall disposed between the pivoting end and the free end, and a linear outside wall opposite the inside wall and disposed between the pivoting end and the free end.

11. A rotary compressor or pump as described in claim 1, wherein, when a piston of the plurality of pistons is pushed into a piston void, pistons on either side of the piston pushed into the piston void are pushed away from a piston void, and a piston to which the piston pushed into the piston void is linked is pushed away from a piston void.

12. A rotary compressor or pump as described in claim 1, wherein the stator comprises an upper annular housing and a lower annular housing, wherein one half of the pistons are positioned in the upper annular housing and one half of the pistons are located in the lower annular housing, and each piston in the upper annular housing is linked to a piston positioned in the lower annular housing that is immediately below it.

13. A rotary compressor or pump as described in claim 1, wherein the stator comprises an upper annular housing and a lower annular housing, wherein one half of the pistons are positioned in the upper annular housing and one half of the pistons are located in the lower annular housing, and each piston in the upper annular housing is linked to a piston positioned in the lower annular housing that is immediately below it;

wherein as the cam pushes a piston located in the upper annular housing into a piston void of the upper annular housing a piston located in the lower annular housing to which the piston located in the upper annular housing is linked rotates out of a piston void of the lower annular housing.

14. A rotary compressor or pump as described in claim 1, wherein the stator comprises an upper annular housing and a lower annular housing, and wherein the stator is enclosed by a top panel and a bottom panel.

* * * * *